US005156457A

United States Patent [19]

Dubach

[11] Patent Number: 5,156,457

[45] Date of Patent: Oct. 20, 1992

[54] LAMP BASE

[75] Inventor: Fredi Dubach, Bäretswil, Switzerland

[73] Assignee: Expo Products Trading Sulser & Cie., Saland, Switzerland

[21] Appl. No.: 831,450

[22] Filed: Feb. 5, 1992

[30] Foreign Application Priority Data

Feb. 14, 1991 [DE] Fed. Rep. of Germany ..... 9101690
May 18, 1991 [EP] European Pat. Off. ... EP91108076.0

[51] Int. Cl.[5] ..... F21S 1/10

[52] U.S. Cl. ..... 362/431; 362/396; 403/391

[58] Field of Search ..... 362/396, 431; 403/391, 403/394

[56] References Cited

U.S. PATENT DOCUMENTS 3,360,883 1/1968 Glanzer ..... 403/391
3,677,582 7/1972 Flick ..... 403/391
4,779,175 10/1988 Chernack ..... 362/396

*Primary Examiner*—Carroll B. Dority
*Attorney, Agent, or Firm*—Spencer, Frank & Schneider

[57] ABSTRACT

A lamp for a folding display including a front horizontal bar and a rear horizontal bar articulatedly connected with each other like scissors and onto which the lamp is stably positioned by its own weight in use yet is easily detached, the lamp including a lamp base including a plate having an upper side and a lower side which oppose each other, the upper side having defined therein, transversely across the entire width thereof, at least one receptacle channel which is freely accessible from above and which has dimensions effective for engaging at least a portion of a rear horizontal bar of a folding display in use, and the lower side having defined therein, transversely across the entire width thereof, at least one receptacle channel which is freely accessible from below and which has dimensions effective for engaging at least a portions of a front horizontal bar of a folding display in use.

5 Claims, 2 Drawing Sheets

LAMP BASE

CROSS-REFERENCE TO RELATED APPLICATIONS

This Application claims the priority of Application Ser. No. 91 01 690.8 filed on Feb. 14, 1991 in Germany and Application No. 91 108 076.0 filed on May 18, 1991 in Europe, the subject matter of both of which is incorporated herein by reference.

BACKGROUND OF THE INVENTION

1. Field of the Invention

The invention relates to a lamp for a folding display including a horizontally extending pair of bars articulately connected with each other like scissors onto which the lamp is mounted. The lamp has a lamp base provided at its rear end with at least one receptacle which is freely accessible from above and which engages one of the bars of the folding display. The lamp base is placed on the bar and spaced horizontally therefrom in such a way that the lamp is held fast by its own weight onto the folding display but may be easily detached.

2. Description of the Related Art

Such folding displays consist principally of a structure including articulatedly connected bars which fold down into a folded state in which the display can be transported easily and space savingly. The display can be then folded out to an unfolded state to provide a three-dimensional display structure onto which articles can be mounted for display. In the unfolded state, the folding display can be quite large, for example, the display may occupy a complete wall. Such folding displays are distributed by several firms, for example, by the assignee hereof, Expo Products Trading Sulser & Cie of Switzerland, who distributes folding displays under the trademarks "Expostar" and "Expofix".

Lamps for known folding displays are fastened in an easily detachable manner to a fairly large U-shaped hoop which is mounted on the folding display. The U-shaped hoop is provided with receptacles at both ends which are freely accessible from above and which grip the rear bars of the structure. The hoop, together with its lamp, extends in front of the front bars of the structure and is fastened by its own weight to the folding display but may be easily detached. Another mode of fastening the hoop uses the articulating joint of the structure. This mode, however, automatically has the effect that the illuminating member of the lamp, e.g., a light bulb, is not placed over the center of the display onto which, for example, a poster is mounted, but is positioned at the border of the poster and provides poor illumination.

Such structures, moreover, are, first, dependant on the positions of the joints, second, only usable for a particular bar or tube diameter, and third, are either unstable or complicated to fasten, and are relatively heavy and generally quite expensive.

Moreover, this know structural design is not completely satisfying from an aesthetic point of view, particularly since a very broad hoop must be used for reasons of stability. Also, the known system provides no device for guiding the electrical cable of the lamp to the plane of the folding display. Rather, the electrical cable of prior designs emerges at the lamp itself in the central area of the U-shaped hoop and runs externally along a leg of the hoop to the folding display and onward. This does not present an especially attractive appearance.

Folding displays are usually manufactured in two sizes which utilize bars or tubes with different diameters. The known lamp has a lamp base with receptacles for engaging the hoop which are open from above, however, they are only sized for one bar diameter. This means that a different hoop and lamp base must be applied for each bar diameter in order to mount the lamp to the display. This complicates particularly the storage capability of the folding display and its lamps.

SUMMARY OF THE INVENTION

It is an object of the present invention to provide a lamp for a folding display which occupies considerably less space, is easily attached and detached, and is distinguished by an especially attractive appearance.

It is a further object of the invention to provide a lamp for a folding display which includes a lamp base suitable for mounting the lamp onto folding displays having different size bars or tubes.

These and other objects are accomplished by the present invention which provides a lamp for a folding display including a front horizontal bar and a rear horizontal bar articulatedly connected with each other like scissors and onto which the lamp is stably positioned by its own weight in use yet is easily detached. The lamp includes a lamp base including a plate having an upper side and a lower side which oppose each other. The upper side has defined therein, transversely across the entire width thereof, at least one receptacle channel which is freely accessible from above and which has dimensions effective for engaging at least a portion of a rear horizontal bar of a folding display in use. The lower side has defined therein, transversely across the entire width thereof, at least one receptacle channel which is freely accessible from below and which has dimensions effective for engaging at least a portions of a front horizontal bar of a folding display in use. The lamp is thus essentially cantilevered from horizontal bars of the folding display.

The lamp base therefore is, in essence, one single plate, the width of which is sufficient to give to the lamp the required stability when positioned, i.e., hung onto or cantilevered from the folding display. The at least one receptacle channel defined in the upper side of the plate is, like receptacles for some prior art lamp bases, freely accessible from above, however, the inventive receptacles are channels defined in a plate and these receptacles are considerably broader than prior art receptacles. Not previously taught in the art, moreover, is the additional provision by the present invention of at least one receptacle channel defined in the lower side of the plate which is freely accessible from below. This contributes additional stability to the structure.

An important embodiment of the invention has a second pair of receptacle channels provided in the plate, namely, a futher receptacle channel freely accessible from above defined in the upper side of the plate and a further receptacle channel freely accessible from below defined in the lower side of the plate. The second receptacle channels, moreover, have a cross-sectional width which is different from the cross-sectional width of the first receptacle channels.

The upper and lower sides of the plate may thus each have defined therein a pair of receptacle channels. Each receptacle channel of the respective pairs has a width which is different from the width of the other receptacle channel of the respective pair. This has the advantage of permitting effective engagement of horizontal bars of folding displays having different diameters. Bars of one diameter may be effectively engaged by one receptacle channel of each respective pair of receptacle channels, while bars of another diameter may be effectively engaged by the other receptacle channel of each respective pair of receptacle channels. In this way, one and the same lamp system is suited for folding displays having bars with different diameters.

This arrangement can be further improved upon by providing receptacle channels of each respective pair of receptacle channels which cross one another at a cross point. This means that the receptacle channels on the upper side, which are freely accessible from above, cross each other, and the receptacles channels on the lower side, which are freely accessible from below, cross each other. In this arrangement, the space on the upper and lower sides of the plate is especially well utilized without unduly weakening the plate. However, other embodiments are conceivable. Since the receptacle channels are provided with a cross-sectional profile having a shape corresponding to the shape of the bar or tube of the folding display it is intended to engage, profiled receptacle channels with step-like depressions for receiving two bar diameter sizes may be provided. Alternately, parallel extending pairs of receptacles may be provided, and so on.

In addition to a lamp base, the lamp further includes a lamp housing enclosing a socket and an electrical cable connected to the socket and extending through the lamp housing. According to the present invention, the lamp base preferably includes a tube which is mounted to the front side of the plate of the lamp base and has a free end to which the lamp housing is mounted and through which tube the electrical cable is guided. This permits the outlet end of the electrical cable to be guided to the plane of the folding display and onward without the need to take additional measures.

The tube of the lamp is angled to shed light on the desired portion of the folding display. Preferably, the tube has longitudinal axis and the lamp base has a front side defining a plane, and the longitudinal axis of the tube and the above plane include an angle 8 which deviates from 90° by only a small amount, such as, by 10° or less, preferably by 5° or less. Thus, the lamp is provided rectangularly to the plane of the folding display.

BRIEF DESCRIPTION OF THE DRAWINGS

The invention may be better understood by referring to the detailed description of the invention when taken in conjunction with the accompanying drawing in which.

BRIEF DESCRIPTION OF THE PREFERRED EMBODIMENTS

Figure 1:
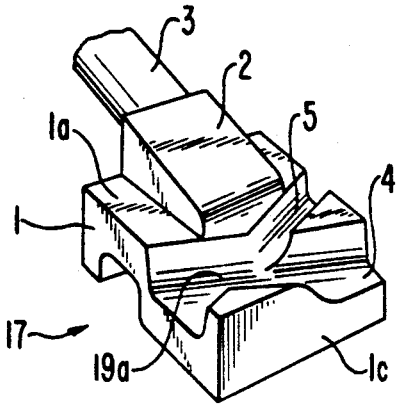
FIG. 1 is a perspective view of a plate of a lamp base according to the invention showing an upper side having defined therein a pair of receptacle channels which cross.
Figure 8:
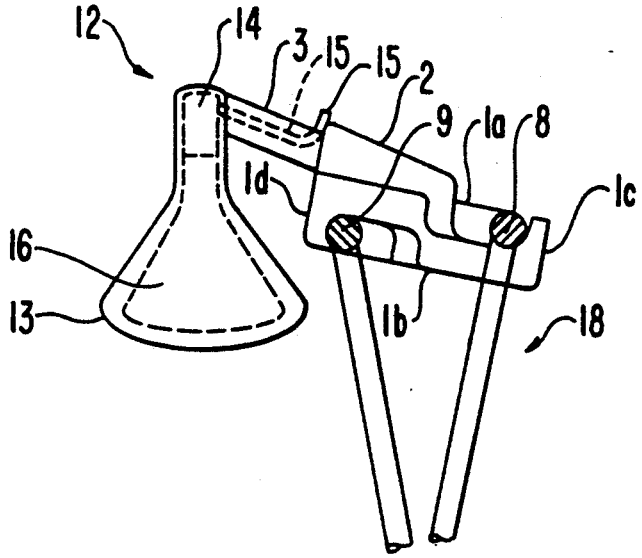
FIG. 8 is a side view in the direction of arrow C of FIG. 7.

FIG. 1 is a perspective view of a lamp base according to the invention shown generally by arrow 17. Lamp base 17 includes a plate 1 having an upper side 1*a*, a lower side 1*b*, a rear side 1*c* and a front side 1*d*. Upper side 1*a* has defined therein receptacle channels 4 and 5. Plate 1 additionally includes a cubelike projection 2 formed integrally therewith, the upper surface of projection 2 sloping downwardly from front side 1*d* toward rear side 1*c*. Projection 2 serves to receive a tube 3 which supports a lamp housing 13 shown in FIG. 8 as accommodating socket 14, electrical cable 15, and light bulb 16. Electrical cable 15 is connected to socket 14, is guided through tube 3, and emerges out of tube 3 near projection 2 as shown in FIG. 8.

Plate 1 and projection 2 are preferably made integral to one another and are preferably made of metal. Plate 1 and projection 2 may also be made of a suitable synthetic resin and fabricated, for example, in a molding process.

Figure 2:
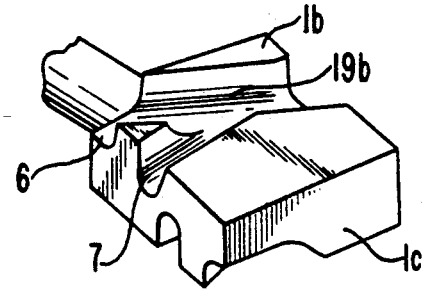
FIG. 2 is a perspective view of the plate of the lamp base of FIG. 1 showing a lower side having defined therein a pair of receptacle channels which cross.

As shown in FIG. 1, receptacle channels 4, 5 (rear bar receptacles) are defined in upper surface 1*a* of plate 1 and are freely accessible from above in use. Receptacle channels 4, 5 cross at cross point 19*a* and intersect to form an acute angle therebetween. FIG. 2 shows lower side 1*b* of plate 1 having defined therein receptacle channels 6 and 7 (front bar receptacles) which are freely accessible from below in use. Receptacle channels 6, 7 cross at cross point 19*b* and intersect to form an acute angle therebetween.

Figure 3:
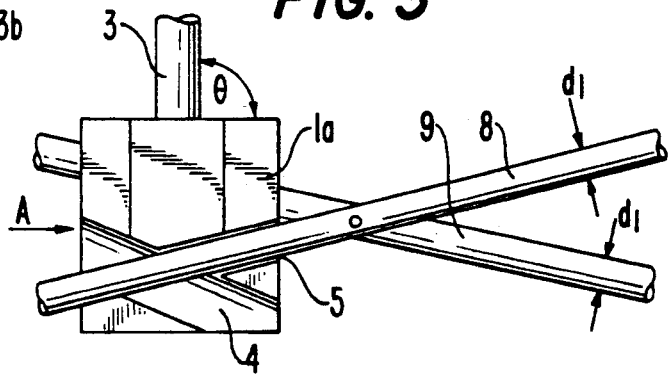
FIG. 3 is a top plan view of a lamp base according to the invention positioned on a pair of bars of a folding display in which each bar has a diameter, for example, of 8 mm.
Figure 7:
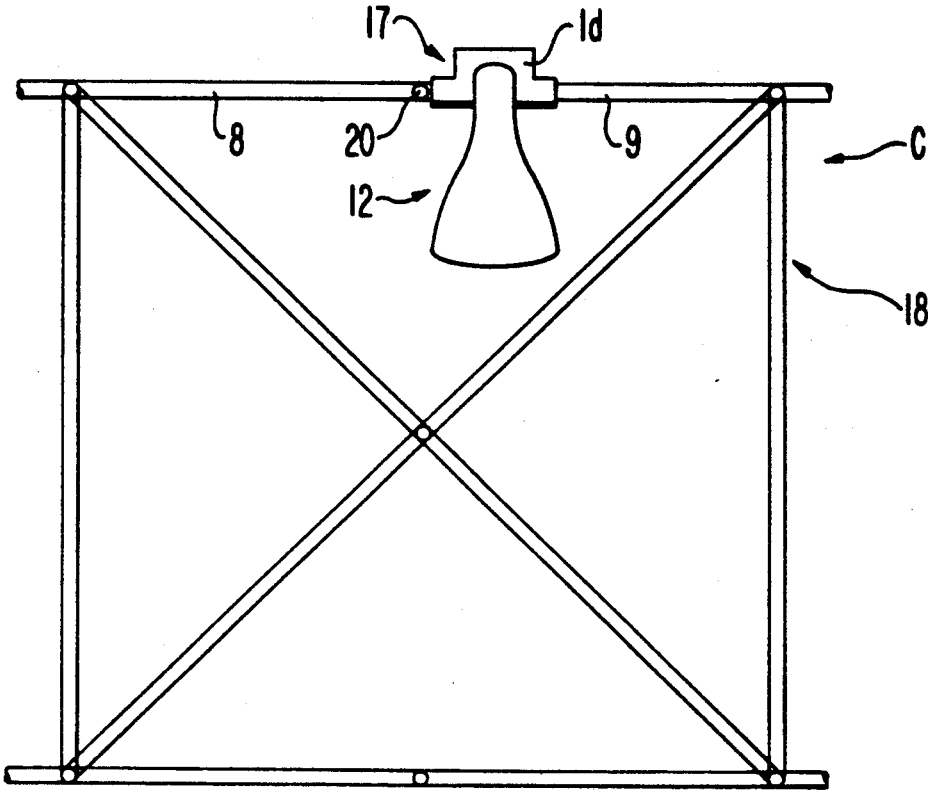
FIG. 7 is a front elevational view of one segment of a folding display onto which is mounted a lamp according to the invention.

FIG. 3 is a top plan view of lamp base 17 positioned, that is, mounted, on a pair of bars, front horizontal bar 9 and rear horizontal bar 8 of a folding display 18 one segment of which is shown in FIG. 7. Front and rear horizontal bars 9, 8 are articulatedly connected with each other like scissors and lamp 12 is stably positioned by its own weight when receptacle channel 6 engages front horizontal bar 9 and receptacle channel 5 engages rear horizontal bar 8. Front and rear horizontal bars 9 and 8 respectively have a diameter $d_1$ which may be, for example, 8 mm. FIG. 3 also shows the angel $\phi$ as referred to in claim 4.

Figure 4:
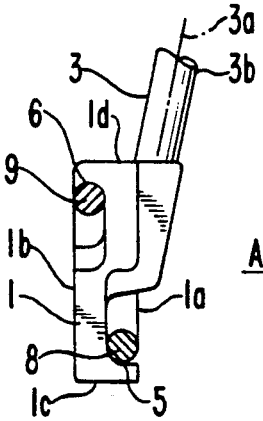
FIG. 4 is a view in the direction of arrow A of FIG. 3.

FIG. 4 is a view in the direction of arrow A of FIG. 3. Front horizontal bar 9 is shown engaged by receptacle channel 6 defined in upper side 1*a* and rear horizontal bar 8 is shown engaged in receptacle channel 5 defined in lower side 1*b*. Tube 3 is additionally shown, as is its longitudinal axis 3*a* and its free end 3*b*.

Figure 5:
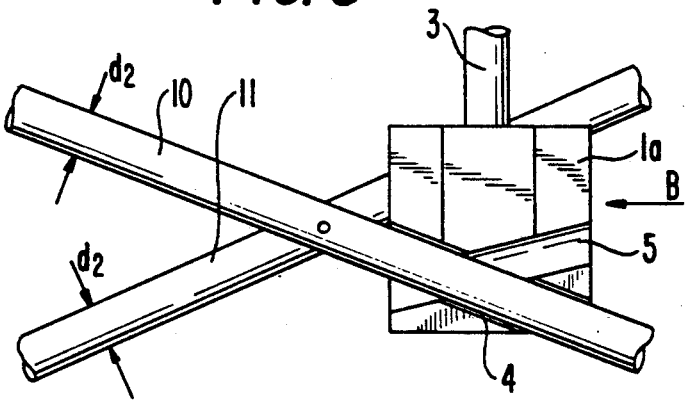
FIG. 5 is a top plan view of the lamp base according to FIG. 3 in which the lamp base is positioned on a pair of bars of a different folding display in which each bar has a diameter, for example, of 12 mm.

FIG. 5 is a top plan view of lamp base 17 according to FIG. 3 positioned on a pair of horizontal bars 10, 11 of a different folding display 18'. Front horizontal bar 11 and rear horizontal bar 10 are articulatedly connected with each other like scissors and lamp 12 is stably positioned by its own weight thereon. Front horizontal bar 11 engages receptacle channel 7 defined in lower side 1*b* and rear horizontal bar 10 engages receptacle channel 4 defined in upper side 1*a*. Front and rear horizontal bars 11, 10 have a diameter $d_2$ which may be, for example, 12 mm.

By defining pairs of receptacle channels 4, 5 and 6, 7 having different widths, advantageously, the inventive lamp 12 can be positioned on folding displays 18, 18' having horizontal bars of different diameters as shown in FIGS. 3 and 5.

Figure 6:
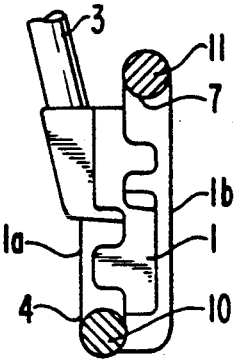
FIG. 6 is a view in the direction of arrow B of FIG. 5.

FIG. 6 is a view in the direction of arrow B of FIG. 5. This figure clearly shows front horizontal bar 11 engaged by receptacle channel 7 defined in lower side 1*b* and rear horizontal bar 10 engaged in receptacle channel 4 defined in upper side 1*a*.

FIG. 7 is a front elevational view of one segment of a folding display 18 onto which is positioned a lamp 12 according to the invention. Front and rear horizontal bars 9, 8 are shown as extending horizontally in the same plane and as having lamp 12 stably positioned thereon by its own weight. The horizontal bars are articulatedly connected with each others like scissors so that front horizontal bar 9 crosses rear horizontal bar 8 at connection point 20, however, for the purposes of this description, the front horizontal bar is the horizontal bar of the folding display closest to the front side 1*d* of plate 1 of lamp base 17.

In FIG. 7 the length of tube 3 is shown much shorter than it is in reality. The long tube gives a good ligthening to the folding display.

FIG. 8 is a side view in the direction of arrow C of FIG. 7. Lamp housing 13 is shown connected to tube 3 at its free end 3*a*. Shown in phantom is socket 14, electrical cable 15, and light bulb 16. Light bulb 16 is positioned in socket 14 and electrical cable 15 is connected to socket 14 and is guided through tube 3 and emerges near projection 2 of plate 1 in the plane of the folding display 18. Electrical cable 15 then extends along folding display 18 and is plugged into a source of electrical power (not shown).

It will be understood that the above description of the present invention is susceptible to various modifications, changes and adaptations, and the same are intended to be comprehended within the meaning and range of equivalents of the appended claims.

What is claimed is:

1. A lamp for a folding display including a front horizontal bar and a rear horizontal bar articulatedly connected with each other like scissors and onto which the lamp is stably positioned by its own weight in use yet is easily detached, the lamp comprising: a lamp having;

a lamp base including a plate having an upper side and a lower side which oppose each other, the upper side having defined therein, transversely across the entire width thereof, at least one receptacle channel which is freely accessible from above and which has dimensions effective for engaging at least a portion of a rear horizontal bar of a folding display in use, and the lower side having defined therein, transversely across the entire width thereof, at least one receptacle channel which is freely accessible from below and which has dimensions effective for engaging at least a portions of a front horizontal bar of a folding display in use; and a tube connecting said lamp housing to said lamp base.

2. The lamp according to claim 1, wherein the upper and lower sides each have defined therein a pair of receptacle channels, each receptacle channel of the respective pairs having a width which is different from the other receptacle channel of the respective pair, whereby horizontal bars of folding displays having different diameters may be effectively engaged by one receptacle channel of each respective pair of receptacle channels.

3. The lamp according to claim 2, wherein the receptacle channels of each respective pair of receptacle channels cross one another at across point.

4. The lamp according to claim 3, wherein the tube has a longitudinal axis, wherein the lamp base has a front side defining a plane, and wherein the longitudinal axis of the tube and the plane include an angle $\theta$ which deviates from 90° by only a small amount.

5. The lamp according to claim 1, wherein the lamp housing includes a socket and an electrical cable connected to the socket, wherein the plate has a front side, and wherein the tube is mounted to the front side of the plate and has a free end to which the lamp housing is mounted and through which the electrical cable is guided.

* * * * *